US007857871B2

(12) United States Patent
Martin et al.

(10) Patent No.: US 7,857,871 B2
(45) Date of Patent: Dec. 28, 2010

(54) METHOD OF REDUCING PARAFFIN DEPOSITION WITH IMIDAZOLINES

(75) Inventors: Richard L. Martin, Pinehurst, TX (US); Harold L. Becker, Tomball, TX (US); Dora Galvan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 667 days.

(21) Appl. No.: 11/220,170

(22) Filed: Sep. 6, 2005

(65) Prior Publication Data

US 2007/0051033 A1 Mar. 8, 2007

(51) Int. Cl.
*C10L 1/232* (2006.01)
*C10M 133/46* (2006.01)

(52) U.S. Cl. ..... 44/342; 44/344; 44/346; 44/393; 44/394; 44/404; 508/283

(58) Field of Classification Search ..... 507/90, 507/243; 44/332, 340, 342, 344
See application file for complete search history.

(56) References Cited

U.S. PATENT DOCUMENTS 2,466,517 A * 4/1949 Gross et al. ..... 507/243
RE23,227 E 5/1950 Blair, Jr. et al.
2,554,222 A 5/1951 Stross et al.
4,722,805 A 2/1988 Martin
4,737,160 A * 4/1988 Efner ..... 44/332
5,273,668 A * 12/1993 Emert et al. ..... 508/189
5,380,466 A 1/1995 Martin
5,504,063 A 4/1996 Becker et al.
5,785,895 A 7/1998 Martin et al.
6,083,288 A * 7/2000 Wolf ..... 44/342
6,100,221 A * 8/2000 Poelker et al. ..... 507/90
6,174,843 B1 1/2001 Peyton et al.
6,309,431 B1 10/2001 Becker et al.

* cited by examiner

*Primary Examiner*—Ellen M McAvoy
*Assistant Examiner*—Chantel Graham
(74) *Attorney, Agent, or Firm*—John Wilson Jones; Jones & Smith, LLP

(57) ABSTRACT

This invention provides a composition and a method of using a composition containing an imidazoline, optionally containing a paraffin inhibitor, for improving the pour point of liquid hydrocarbons, such as crude oil and petroleum fuel, and/or inhibiting or reducing the formation of paraffin deposits in such liquids.

19 Claims, 2 Drawing Sheets

METHOD OF REDUCING PARAFFIN DEPOSITION WITH IMIDAZOLINES

FIELD OF THE INVENTION

The invention relates to a method of reducing pour point and/or inhibiting or retarding the formation of paraffin deposits in liquid hydrocarbons, such as crude oil and petroleum fuel, using imidazolines.

BACKGROUND OF THE INVENTION

Difficulties arise in pumping and/or transporting petroleum fuel or crude oil through flow lines, valves, and pumps in cold climate. Paraffin hydrocarbon waxes naturally occur in many crude oils and are particularly problematic at lower temperatures and in colder climates. As the temperature drops and approaches the crude oil's pour point, such waxes tend to precipitate and crystallize, causing the oil to lose its fluidity.

Various additives, known as pour point depressants, have been developed to reduce pour points in petroleum fuels and crude oils. (Pour point is defined by the ASTM D-97 as "the lowest temperature at which the crude oil will still flow when it is held in a pour point tube at ninety degrees to the upright for five seconds.") Further, paraffin inhibitors have been developed which retard the formation of paraffin deposits.

Many of the pour point depressants and paraffin inhibitors that are presently available solidify at temperatures ranging from −5° C. to 60° C. Such systems are not particularly useful in the field at cold temperatures or under winter conditions. Alternatives have therefore been sought for reducing pour points in hydrocarbon fluids as well as inhibiting or retarding paraffin deposits.

SUMMARY OF THE INVENTION

The invention relates to a method of pour point reduction in liquid hydrocarbons, such as crude oils and petroleum fuels, using imidazolines, including their dimeric and trimeric forms. Imidazolines, when used as pour point depressants, are capable of lowering pour points as much as 30° C.

The invention further relates to a method of reducing or inhibiting the formation of paraffin deposits in crude oils as well as petroleum fuels, by using imidazolines.

The invention also relates to a method of increasing the effectiveness of a non-imidazoline paraffin inhibitor by adding to it an imidazoline. The combination of imidazoline and non-imidazoline paraffin inhibitor exhibits a synergistic effect.

Use of the imidazolines in accordance with the invention can greatly affect the type of environments in which liquid hydrocarbons may be used. For instance, use of the imidazolines aids in pipeline transport and pumpability. As a result, crude and petroleum fuels may be more easily pumped.

DETAILED DESCRIPTION OF THE PREFERRED EMBODIMENTS

Figure 1:
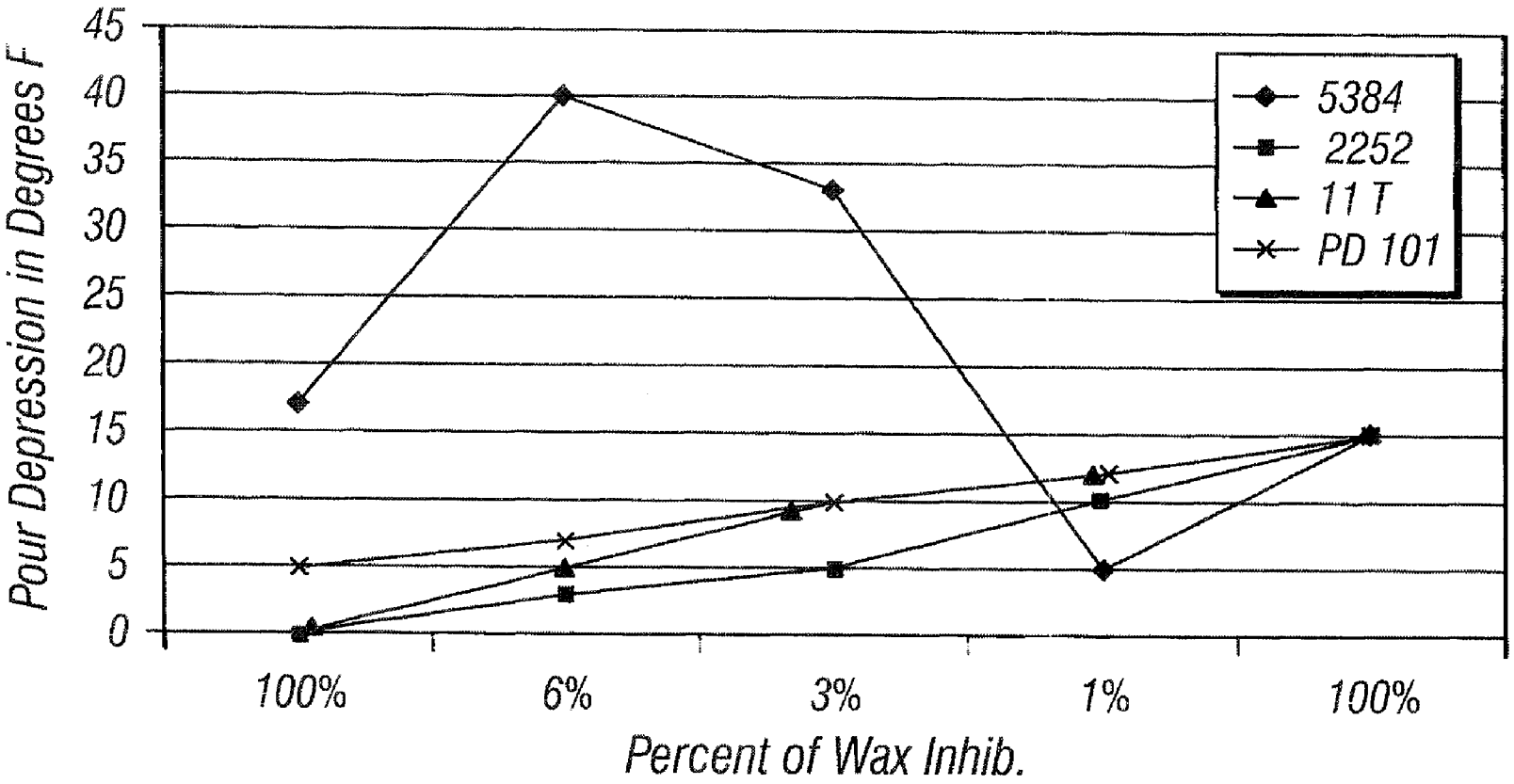
FIG. 1 illustrates the synergism exhibited by non-imidazoline paraffin inhibitors and imidazolines on pour point depression.

The imidazolines for use in the invention permit hydrocarbon liquids to remain fluid and pumpable at temperatures ranging from about −40° C. to about 70° C. Such imidazolines are capable of reducing the pour point of hydrocarbon liquids to colder temperatures. In addition, such imidazolines are capable of inhibiting or retarding the formation of paraffin deposits in hydrocarbon liquids. The invention has particular applicability where the hydrocarbon liquid is crude oil or petroleum fuel.

A composition for use in the invention may include more than one imidazoline. Alternatively, only one imidazoline may be used. Suitable imidazolines for use in the invention are those of the formula:

(I)

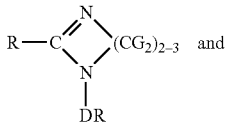

(II)

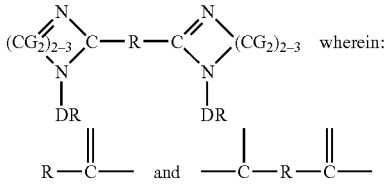

are residues derived from the carboxylic acid employed in preparing the compound, e.g. fatty acids or mixtures of fatty acids wherein R (the residue of the fatty acid) is, for example, a hydrocarbon radical (preferably an unsaturated or polyunsaturated chain), having, for example, 1-30 carbon atoms;

—N═$(CG_2)_{2-3}$N— is the residue derived from the polyamine;

each G is independently hydrogen or a hydrocarbon radical, for example, a $C_1$-$C_4$ alkyl group; for example, $CG_2$ may be:

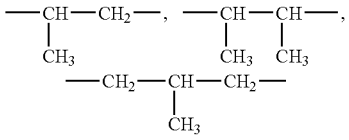

but preferably —$CH_2CH_2$— or —$CH_2CH_2CH_2$—;

DR is $R^2$; —$C_nH_{2n}$—$NR^2$—$R^2$, or $(R^1M)_x$-$(R^4O)_y$—H;

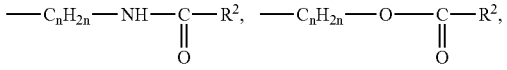

—$C_nH_{2n}$—O—$R^2$, —$C_nH_{2n}$—$NR^2$—$C_nH_{2n}$—, $NR^2$—$R^2$—, $C_nH_{2n}$—$NR^2$—$C_nH_{2n}$—$NR^2$—, $C_nH_{2n}$—$NR^2$—$R^2$, or (III)

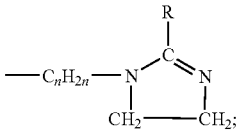

each $R^2$ is independently selected from —H or an aliphatic or cycloaliphatic group, such as a lower alkyl group like a $C_1$-$C_6$ alkyl group;

n is, for example, between 1 to about 6;

$R^1$ is an organic moiety and preferably is an alkylene, an arylene, or an aralkylene. More preferably, $R^1$ is ethylene, isopropylene or —$(CH_2CH_2O)_p(CH_2CH_2)$— wherein p is an integer from 1 to about 30. Even more preferably, $R^1$ is ethylene or the group —$(CH_2CH_2O)_p(CH_2CH_2)$— wherein p is an integer from 1 to about 17. Most preferably, $R^1$ is ethylene;

M is —O—, —N or —S—, most preferably —O—;

each $R^4$ is independently selected from a $C_1$-$C_4$ alkylene group, preferably ethylene;

each x is independently 0 or 1; and y is an integer from 0 to about 30 selected such that the total number of alkoxy units in the N-substituent is from one to about thirty (preferably two to about eighteen), depending on the number necessary to render the imidazoline water-soluble.

Such imidazolines, disclosed in U.S. Pat. Nos. Re 23,227; 4,722,805; and 5,785,895, herein incorporated by reference, are preferred.

Imidazolines for use in the invention may be prepared by reacting a polyamine with a fatty acid and optionally derivatizing the resulting imidazoline, such as by alkoxylation. The fatty acid and polyamine are preferably environmentally compatible. Typically, imidazolines derive from crude fatty acids, such as crude tall oil, and crude amines are more effective than those imidazolines produced from refined components.

A preferred fatty acid is a mono- or poly-unsaturated fatty acid of from about 6 to about 40, preferably about 12 to about 20, carbon atoms. The term polyunsaturated refers to two or more points of unsaturation. Thus, the fatty acid is of the form $R^5COOH$, wherein $R^5$ contains from about 5 to about 40 carbons, preferably from about 11 to about 20 carbons. Particular suitable fatty acids are tall oil, oleic, linoleic and eladeic acid.

The term "polyamine" is used herein to refer to organic moieties containing two amino groups, as well as polyamines having three or more amino groups. For instance, the polyamine may be of the formula $H_2N(CH_2)_hNHR^6$, wherein h is 1 to about 5, preferably 2 or 3, and $R^6$ is —H or $R^1MH$ wherein -MH represents a terminal group that includes a hetero atom such as oxygen, nitrogen or sulfur and at least one hydrogen, thereby to provide a site for attachment of the alkylene oxide, when desired. Preferred are N-substituted ethylene diamines such as, for example, $NH_2CH_2CH_2NH$—$CH_2OH$ and $NH_2CH_2CH_2NH$—$CH_2CH_2OH$.

Examples of suitable polyamines include ethylenediamine, diethylenetriamine, triethylenetetramine, tetraethylenepentamine, 1,2-diaminopropane, N-ethylethylenediamine, N,N-dibutyldiethylenetriamine, 1,2-diaminobutane, hydroxyethylethylenediamine, dipropylenediamine and the like.

The polyamine and fatty acid are reacted in about a 1:1 to about 1:1.5 molar ratio of fatty acid:polyamine under a vacuum with the addition of heat, such as up to about 240° C., until all water is removed. The resulting imidazoline may then be alkoxylated, if desired, to build the N-substituent of the imidazoline to include a total of from 1 to about 30 alkoxy units as necessary to render the product water-soluble. For instance, as used herein, the term water-soluble means miscible with water at the concentration to be employed as a pour point depressant.

By use of the imidazolines, the flow and transportation of petroleum fuels and crude oil through tubing, flow lines and pumps is therefore not impeded. The invention is particularly useful for treating petroleum fuels in cold climates and under winter conditions. The imidazolines are especially suitable for lowering the pour point of solutions of paraffin hydrocarbons. The imidazolines may further be used in lubricating oils, such as naphthenic or paraffinic lubricating oils.

Typically, the quantity of imidazoline added to the crude oil or petroleum fuel is between about 20 to about 500 ppm. The amount employed may be dependent on the paraffin content of the liquid hydrocarbon.

Dimers and/or trimers of the above-referenced fatty acids may further be combined with the imidazoline(s), especially when it is desired for the composition to exhibit corrosion inhibition properties. Such dimers and/or trimers may be derived from crude fatty acids. When present, the weight percentage of imidazoline:dimer/trimer is generally between from about 5:1 to 1:1.

Appropriate diluents may also be used including heavy aromatic solvents. Typically, the flash point of the heavy aromatic solvent is in the range of from about 160° F. to about 350° F. When employed, the heavy aromatic solvent is preferably a high boiling refinery product comprised of a varying mixture of principally aromatic compounds. The aromatic compounds which can be included in the heavy aromatic solvent include alkyl substituted benzene compounds wherein the alkyl substituents have about 1 to about 10 carbon atoms; naphthalene; alkyl substituted naphthalene wherein the alkyl substitutes have about 1 to about 10 carbon atoms and mixtures thereof. When employed, the weight percent of diluent is typically from about 10 to about 90 weight percent, preferably from about 70 to about 80 weight percent. Non-aromatic constituents such as kerosene, certain fuel oils, or any alkyl hydrocarbon, may further be included in the heavy aromatic solvent but preferably in volume proportions less than or equal to 5 weight percent.

In a preferred embodiment of the invention, the imidazoline(s) may be combined with one or more conventional or non-imidazoline paraffin inhibitors. The resulting combination has a synergistic ability to inhibit paraffin deposition. As such, the inhibition properties of the non-imidazoline paraffin inhibitor(s) are dramatically improved when the imidazoline(s) is added thereto. Suitable as the conventional paraffin inhibitors are alkyl acrylate copolymers, alkyl acrylate vinylpyridine copolymers, ethylene vinyl acetate copolymers, maleic anhydride ester copolymers, branched polyethylenes, naphthalene, anthracene, microcrystalline wax and/or asphaltenes. When employed, the amount of non-imidazoline paraffin inhibitor present in the composition is between from about 2 to about 30 percent by weight, more preferably from about 5 to about 15 weight percent.

The imidazolines for use in the invention exhibit corrosion inhibition properties; such properties are not adversely affected by the addition of paraffin inhibitors.

The imidazolines may further be used in admixture or in conjunction with other additives and agents used in oil and gas wells, such as conventional emulsifiers, demulsifiers, dispersing agents, surfactants, scale inhibitors and the like. Typically, such additives and agents are used in amounts from about 5 to about 500 ppm. Exemplary of such additives are alkyl or aralkyl polyoxyalkylene phosphate ester surfactants The following examples will illustrate the practice of the present invention in a preferred embodiment. Other embodiments within the scope of the claims herein will be apparent to one skilled in the art from consideration of the specification and practice of the invention as disclosed herein. It is intended that the specification, together with the Examples, be considered exemplary only, with the scope and spirit of the invention being indicated by the claims which follow.

EXAMPLES

Example 1

Composition A was prepared by combining 76.3 weight percent of a heavy aromatic distillate, 2 weight percent isopropyl alcohol, 11.8 weight percent an imidazoline derived from a 1:2 weight ratio of diethylene triamine and tall oil fatty acid, 3.2 weight percent dimer and trimer tall oil fatty acids, 5.2 weight percent of oil soluble phosphate ester of ethoxylated octyl to tetra decyl alcohol, 1 weight percent of demulsifier, TB-976, a product of BJ Services Company, and 0.5 weight percent oxyalkylated nonyl phenol. Crude diethylene triamine and tall oil fatty acid were used as the source of imidazoline. The dimers and trimers were further derived from crude tall oil fatty acid.

Composition B was prepared by combining 25 weight percent of an imidazoline derived from a 1:2 weight ratio of refined diethylene triamine and refined tall oil fatty acid and 75 weight percent of a heavy aromatic distillate.

Composition C was prepared by combining 25 weight percent crude imidazoline (derived from a 1:1.5 weight ratio of crude diethylene triamine and crude tall oil fatty acid) with 75 weight percent heavy aromatic distillate.

Composition D was prepared by mixing 10 weight percent ethylene vinyl acetate copolymer, commercially available from E.I. DuPont de Nemours, into a heavy aromatic distillate.

Two crude oils, one from Utah and the other from Mexico, had their pour points lowered by the addition of these inhibitors. The amount of each Composition added to each crude sample was 250 ppm. The results, ASTM 97, are set forth in Table I below:

TABLE I

| | Point Pour Reduction, ° F. | | | |
|---|---|---|---|---|
| | Composition A | Composition B | Composition C | Composition D |
| Utah Crude | 25 | 27 | 32 | 15 |
| Mexican Crude | 15 | 15 | 25 | 20 |

Example 2

The change in deposited paraffin content in the crude oils of Example 1 using Composition A, B, C and D was determined by a "Cold Finger Test," as described at page 115 of CRUDE OIL, WAXES, EMULSIONS AND ASPHALTENES by J. R. Becker, published by PennWell Publishing Co. in Tulsa, Okla., wherein a surface (cold finger) was placed in a sample of the heated crude oil and cooling fluid (provided by a thermostatically controlled circulating heating and cooling bath) was circulated through the interior of the cold finger. The oil was gently agitated about the cold finger with a magnetic stirrer while the oil was maintained at a temperature above its cloud point, and deposits form on the cold finger's surface. The amount of deposits was determined and contrasted with the amount of deposits formed in comparative samples containing no Composition A, B, C or D. The average results are set forth in Table II:

TABLE II

| Percent Prevention | | | |
|---|---|---|---|
| Composition A | Composition B | Composition C | Composition D |
| NONE | NONE | 28% | 30% |

Example 3

The effect of imidazolines on conventional or non-imidazoline paraffin inhibitors was compared. The imidazoline used in this Example was Composition A. The paraffin inhibitors used were:

5384, an ethylene vinyl acetate paraffin inhibitor, commercially available from E. I. DuPont de Nemours and Company;

2252, a maleic anhydride ester paraffin inhibitor, commercially available from Lubrizol;

11T, a copolymer of behenyl methacrylate and vinyl pyridine, a paraffin inhibitor commercially available from Shell Oil; and PD101, a maleic anhydride/olefin ester paraffin inhibitor, commercially available from P Chem.

About 250 ppm of the samples was introduced to Devon Freston crude, in accordance with the procedures set forth in Example 1 above. The composition of the samples varies from 100% conventional paraffin inhibitor (no solvent added) to 100% imidazoline (no solvent added). The remaining compositions contained about 25% of imidazoline, 1 to 6% of paraffin inhibitor and heavy aromatic distillate as the balance.

FIG. 1 shows the differences in synergistic effect that result when the imidazoline is combined with paraffin inhibitor. Paraffin inhibitors 5384 and PD 101 function as pour point depressants without the addition of any imidazoline. Such paraffin inhibitors exhibit greater synergistic effects than 11 T and 2252 which do not exhibit pour depressant abilities in Devon Freston crude, when used alone.

Figure 2:
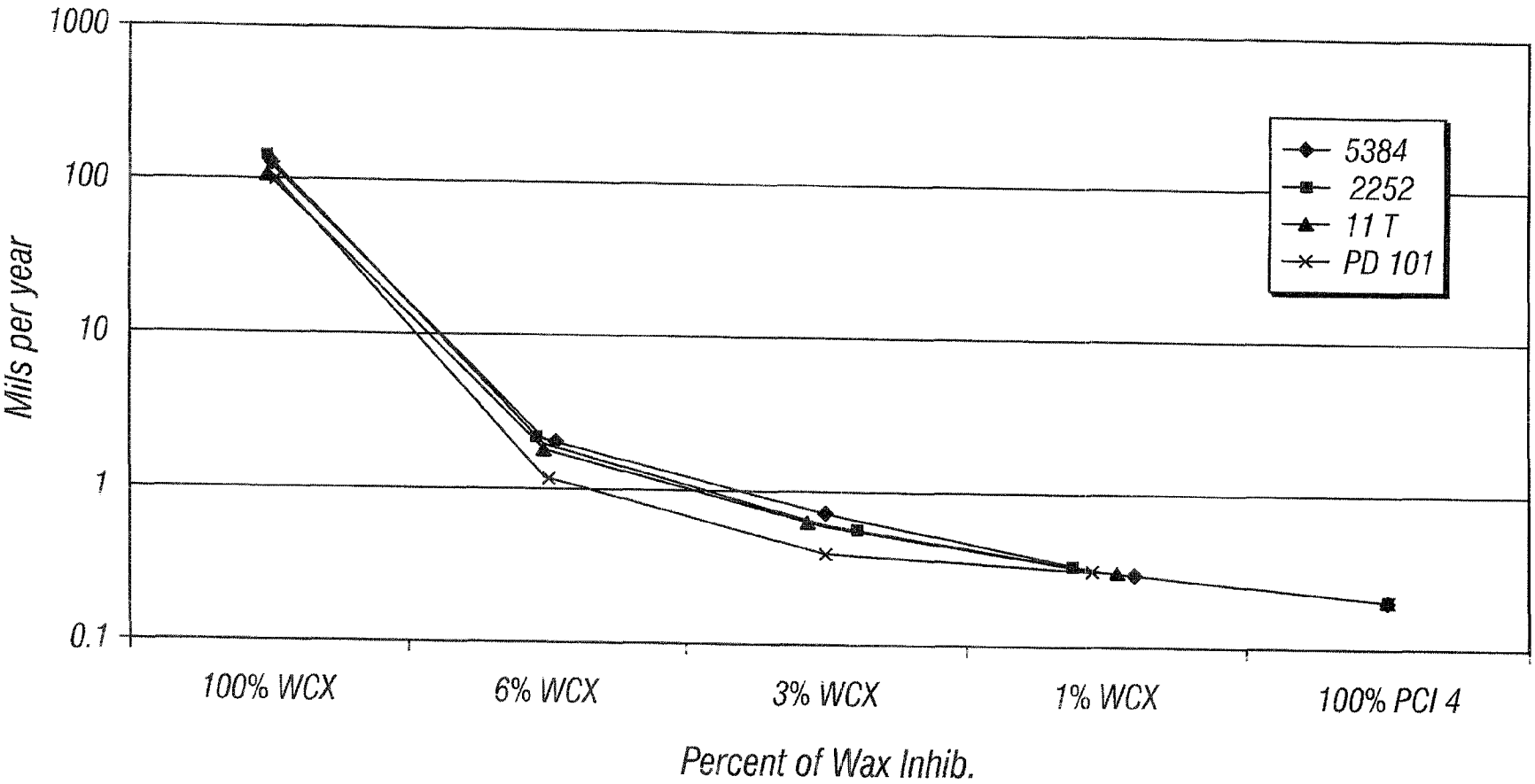
FIG. 2 shows the effect of the compositions of the invention on corrosion inhibition.

FIG. 2 shows the mils per year degraded as a consequence of corrosion. Metal coupons where soaked in the formulations at a temperature of 22° C. Corrosion was measured for 24 hours by linear polarization resistance (1.p.r.). The 1.p.r. rates were averaged for each 24 hour test. FIG. 2 shows that corrosion inhibition of the imidazolines was relatively unaffected by the addition of the non-imidazoline paraffin inhibitor. Note that the amount of corrosion in 100% imidazoline was slightly lower than the amount of corrosion in the composition containing 6 weight percent of paraffin inhibitor.

Example 4

Composition E, F and G were prepared by combining about 75 weight percent of a heavy aromatic distillate, 25 weight percent of imidazoline.

In Composition E, the imidazoline was derived from refined diethylene triamine and refined tall oil fatty acid (in a weight ratio of about 1:2).

In Composition F, the imidazoline was derived from refined diethylene triamine and refined tall oil fatty acid (in a weight ratio of about 1:1.1).

In Composition G, the imidazoline was derived from crude diethylene triamine and crude tall oil fatty acid (in a weight ratio of about 1:1.5).

About 250 ppm of each composition was introduced to Mexican crude in accordance with ASTM D-97. The results are set forth in Table III:

TABLE III

| | Point Pour Reduction, ° F. | | |
|---|---|---|---|
| | Composition E | Composition F | Composition G |
| Utah Crude | 15 | 30 | 30 |

From the foregoing, it will be observed that numerous variations and modifications may be effected without departing from the true spirit and scope of the novel concepts of the invention.

What is claimed is:

1. In a method of reducing the deposition of paraffin in a petroleum fuel or crude oil by the addition of a paraffin inhibitor to the petroleum fuel or crude oil, the improvement comprising adding to the petroleum fuel or crude oil an imidazoline (in combination with the paraffin inhibitor), wherein the amount of paraffin deposited in the petroleum fuel or crude oil is less when the combination of paraffin inhibitor and imidazoline is added to the petroleum fuel or crude oil than when the paraffin inhibitor is added to the petroleum fuel or crude oil without the imidazoline and further wherein the imidazoline is of the formula:

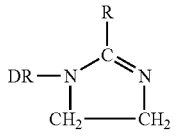

wherein R is a $C_1$-$C_{30}$ hydrocarbon radical; DR is $R^2$ or —$C_nH_{2n}$—$NR^2$—$R^2$; each $R^2$ is independently selected from —H or a $C_1$-$C_6$ alkyl group; and n is from about 1 to about 6.

2. The method of claim 1, wherein the imidazoline exhibits corrosion inhibition properties and further wherein the corrosion inhibition properties of the imidazoline are not adversely affected by the paraffin inhibitor.

3. The method of claim 1, wherein the imidazoline is derived from a diamine or triamine.

4. The method of claim 3, wherein the triamine is diethylene triamine.

5. The method of claim 1, wherein the imidazoline is derived from a mono- or poly-unsaturated fatty acid of from about 6 to about 40 carbon atoms.

6. The method of claim 5, wherein the fatty acid is a mono- or poly-unsaturated fatty acid of from about 12 to about 20 carbon atoms.

7. The method of claim 5, wherein the fatty acid is tall oil.

8. The method of claim 1, wherein the imidazoline is derived from a crude fatty acid and a crude polyamine.

9. The method of claim 1, wherein the imidazoline is added to the crude oil or petroleum fuel in an amount of about 20 to about 500 ppm.

10. The method of claim 1, wherein the imidazoline is derived from about a 1:1 to about a 1:1.5 molar ratio of fatty acid:polyamine.

11. The method of claim 1, wherein a dimer and/or trimer of fatty acid is further added with the imidazoline to the petroleum fuel or crude oil.

12. The method of claim 1, wherein a heavy aromatic solvent is further added with the imidazoline to the petroleum fuel or crude oil.

13. The method of claim 1, wherein the paraffin inhibitor is a non-imidazoline selected from the group consisting of an ethylene vinyl acetate copolymer, a maleic anhydride ester and an acrylate or methacrylate and vinyl pyridine.

14. The method of claim 1, wherein the paraffin inhibitor is a non-imidazoline selected from the group consisting of branched polyethylenes, naphthalene, anthracene, microcrystalline wax and asphaltenes.

15. The method of claim 7, wherein the imidazoline is derived from diethylenetriamine.

16. The method of claim 13, wherein the paraffin inhibitor is an ethylene vinyl acetate copolymer.

17. The method of claim 1, wherein the amount of paraffin inhibitor in the imidazoline and paraffin inhibitor mixture added to the petroleum fuel or crude oil is between from about 2 to about 30 percent by weight.

18. The method of claim 17, wherein the amount of paraffin inhibitor in the imidazoline and paraffin inhibitor mixture added to the petroleum fuel or crude oil is between from about 3 to about 15 percent by weight.

19. The method of claim 18, wherein the amount of paraffin inhibitor in the imidazoline and paraffin inhibitor mixture added to the petroleum fuel or crude oil is between from about 3 to about 6 percent by weight.

* * * * *